US006421116B1

(12) United States Patent
Schilli et al.

(10) Patent No.: US 6,421,116 B1
(45) Date of Patent: Jul. 16, 2002

(54) METHOD FOR DETERMINING THE RELATIVE MOVEMENT BETWEEN MISSILE AND TARGET

(75) Inventors: Thomas Schilli, Frickingen; Norbert Bins, Überlingen, both of (DE)

(73) Assignee: Bodenseewerk Geratetechnik GmbH, DEX ( * ) Notice: Subject to any disclaimer, the term of this patent is extended or adjusted under 35 U.S.C. 154(b) by 0 days.

(21) Appl. No.: 09/637,184

(22) Filed: Aug. 11, 2000

(30) Foreign Application Priority Data

Aug. 23, 1999 (DE) ..... 199 39 935

(51) Int. Cl.[7] ..... G01P 3/36; F41G 7/00; G01C 17/00; G06K 9/00

(52) U.S. Cl. ..... 356/28; 244/3.16; 702/150; 382/103

(58) Field of Search ..... 102/213; 356/141.1, 356/152.1, 28; 244/3.16; 702/150–153; 382/103

(56) References Cited

U.S. PATENT DOCUMENTS 3,843,076 A * 10/1974 King et al. ..... 244/3.16
4,288,050 A * 9/1981 Gauggel ..... 244/3.16
4,383,663 A * 5/1983 Nichols ..... 244/3.16
5,062,584 A 11/1991 Neff et al.
5,275,354 A 1/1994 Minor et al.
5,669,581 A * 9/1997 Ringer ..... 244/3.16
5,932,833 A * 8/1999 Hammon et al. ..... 102/213

FOREIGN PATENT DOCUMENTS

CH 675638 A5 10/1990
DE 3631944 A1 4/1988
DE 3835883 A1 4/1990
EP 0508905 A1 10/1992

* cited by examiner

*Primary Examiner*—Stephen C. Buczinski
(74) *Attorney, Agent, or Firm*—Mallinckrodt & Mallinckrodt; Robert R. Mallinckrodt

(57) ABSTRACT

The invention relates to a method for determining the relative movement between a target tracking missile and a target being located at a target distance from said missile. The missile is equipped with an image processing seeker head provided with a seeker detecting said target. The seeker head observes the target in an observation direction. A target image is generated on the seeker. The size of the target image depends on the observation direction. The target moves with a target velocity relative to the missile. The method has the method steps of: defining a seeker head-fixed coordinate system; defining a maximum absolute size of said target; measuring further relevant quantities; and running a recursive algorithm in order to obtain estimated values of a three-dimensional vector of the target velocity in the seeker head-fixed coordinate system by using as inputs the defined maximum absolute size of the target and the image dimension appearing on the seeker as well as further relevant quantities.

11 Claims, 4 Drawing Sheets

METHOD FOR DETERMINING THE RELATIVE MOVEMENT BETWEEN MISSILE AND TARGET

BACKGROUND OF THE INVENTION

This invention relates to a method for determining the relative movement between a target tracking missile having an image processing seeker head and a target detected by the seeker head.

In many cases it is useful to determine the relative movement of a target detected by the seeker head relative to the missile or to the seeker head. This can result in an improvement of the effectiveness of the missile.

If a high rate of direct hits is achieved by optimizing the guidance law, then the mass of the war head can be kept small. A small war head improves the radius of action of the missile. Furthermore, the manoeuverability of the missile is improved. In the case of a direct hit, the charge of explosives of the war head can be detonated by an impact fuse. However, a small war head has disadvantages when the target is missed closely. Then high demands are made on the fuse delay law, according to which the war head is triggered by means of a proximity fuse after the target has been detected According to the prior art, the approach to the target is detected by means of an active radar sensor or a laser.

An important component of the "fuse delay law" is the trigger delay. This is the delay between a proximity signal generated by the proximity sensor and the actual triggering. A target is not vulnerable everywhere to the same extent. If the charge of explosives of the war head is triggered too early or too late by some fractions of a second, then the effect of the charge of explosives is not optimal. The target is not sufficiently damaged.

The optimal trigger delay depends, among other factors, on the vectorial target velocity relative to the missile and on the angle between the velocity vectors of the missile and of the target. This angle is called "relative trajectory angle". Normally, these quantities are not available.

The effectiveness of a missile may also be improved by adaptation of the guidance gain in the guidance law to the relative velocity and position of the target relative to the missile.

SUMMARY OF THE INVENTION

One of the objects of the present invention is hence to estimate the relative movement between missile and target.

This and other objects are achieved by a novel method of determining the relative movement between a target tracking missile and a target. The target is located at a target distance from the missile and moves with a target velocity relative to the missile. The missile is equipped with an image processing seeker head detecting the target. The seeker head observes the target in an observation direction. When the seeker detects the target, a target image appears on the seeker with target image dimensions. The target image dimensions depend, in known manner, on the observation direction. A seeker head-fixed coordinate system is defined. A maximum absolute size of the target is defined. Further relevant quantities are measured. A recursive algorithm is run in order to obtain estimated values for a three-dimensional vector of the target velocity in the seeker head-fixed coordinate system, using as input the defined maximum absolute size of the target and the image dimensions appearing on the seeker as well as the further relevant quantities.

Some quantities can be directly measured. Such quantities are, for example, the velocity of the missile and the inertial line-of-sight angular rate, both measured in the seeker head-fixed coordinate system, as well as the remaining time of flight. The more distant the target is from the missile, the smaller is the target image with predetermined maximum absolute size of the target (in meters). Furthermore, the size of the target image depends on the direction, from which the missile observes the target, that means the so called off-tail angle OTA. At first, this off-tail angle is unknown, and so is also the distance of the target from the missile. Initial values of the unknown quantities are input together with the directly measurable quantities into a recursive algorithm. The algorithm provides estimated values for the velocity vector of the target, likewise in the seeker head-fixed coordinates. These estimated values of the velocity vector of the target and the unknown quantities are increasingly improved by the recursive algorithm.

In a preferred embodiment the method steps comprises:

(a) defining a target type and defining a correspondent maximum absolute target size;

(b) storing a table of visible absolute target sizes as a function of an off-tail angle for at least one target type;

(c) estimating the target distance by using the target image dimensions appearing in the seeker and the visible real target size at an estimated off-tail angle;

(d) determining the missile velocity, the line-of-sight angular rate and the remaining time of flight;

(e) estimate the three-dimensional vector of the relative target velocity in the coordinate system fixed to the seeker head;

(f) determining a target off-tail angle from the relative target velocity; and (g) repeating steps (c) to (f) while using the last calculated target off-tail angle.

Further objects and features of the invention will be apparent to a person skilled in the art from the following specification of a preferred embodiment when read in conjunction with the appended claims.

BRIEF DESCRIPTION OF THE DRAWING

The invention and its mode of operation will be more clearly understood from the following detailed description and the accompanying drawings in which.

DESCRIPTION OF THE PREFERRED EMBODIMENT

Figure 1:
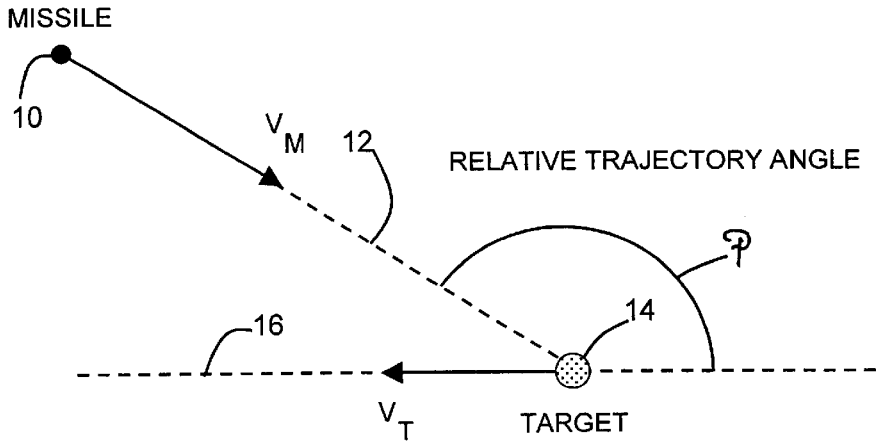
FIG. 1 illustrates the definition of the "trajectory angle"

Referring now to FIG. 1 numeral 10 designates a missile. The missile 10 has a missile velocity which is represented by a three-dimensional vector $V_M$. The missile 10 moves along an instantaneous path 12 in the prolongation of the vector $V_M$. The target is designated by numeral 14. The target 14 has a target velocity which is represented by a three-dimensional vector $V_T$. The target 14 moves along an instantaneous path 16. The two instantaneous paths 12 and 16 form an angle 18. This is the relative trajectory angle.

Figure 2:
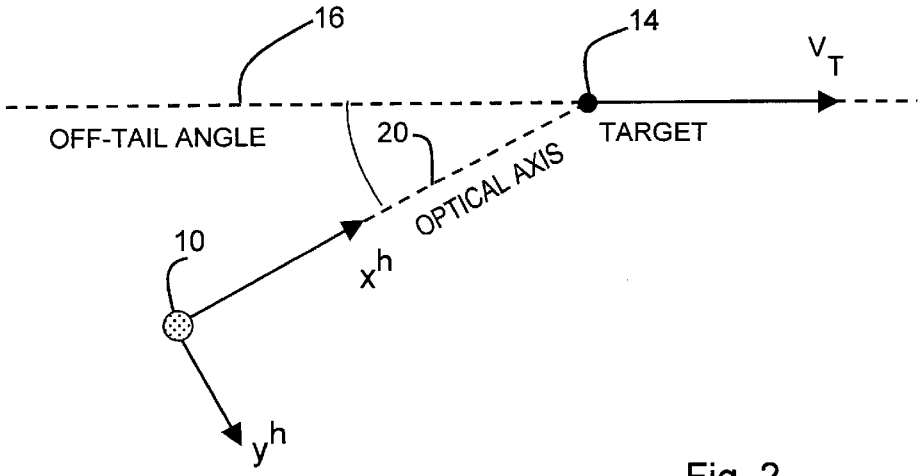
FIG. 2 illustrates the definition of the "off-tail angle"

FIG. 2 shows the missile 10 defining a seeker head-fixed coordinate system. The $x^h$-axis coincides with the optical axis 20 of the seeker head. The $y^h$- and $z^h$-axes are orthogonal to the optical axis 20. The $y^h$-axis can be seen in FIG. 2. The $z^h$-axis is normal to the paper plane of FIG. 2. The target 14 moves along its instantaneous path with the velocity determined by the vector $V_T$. The angle 22 between the optical axis 20 and the path 16 is the "off-tail angle". This is the angle, under which the seeker head laterally "sees" the target.

Figure 3:
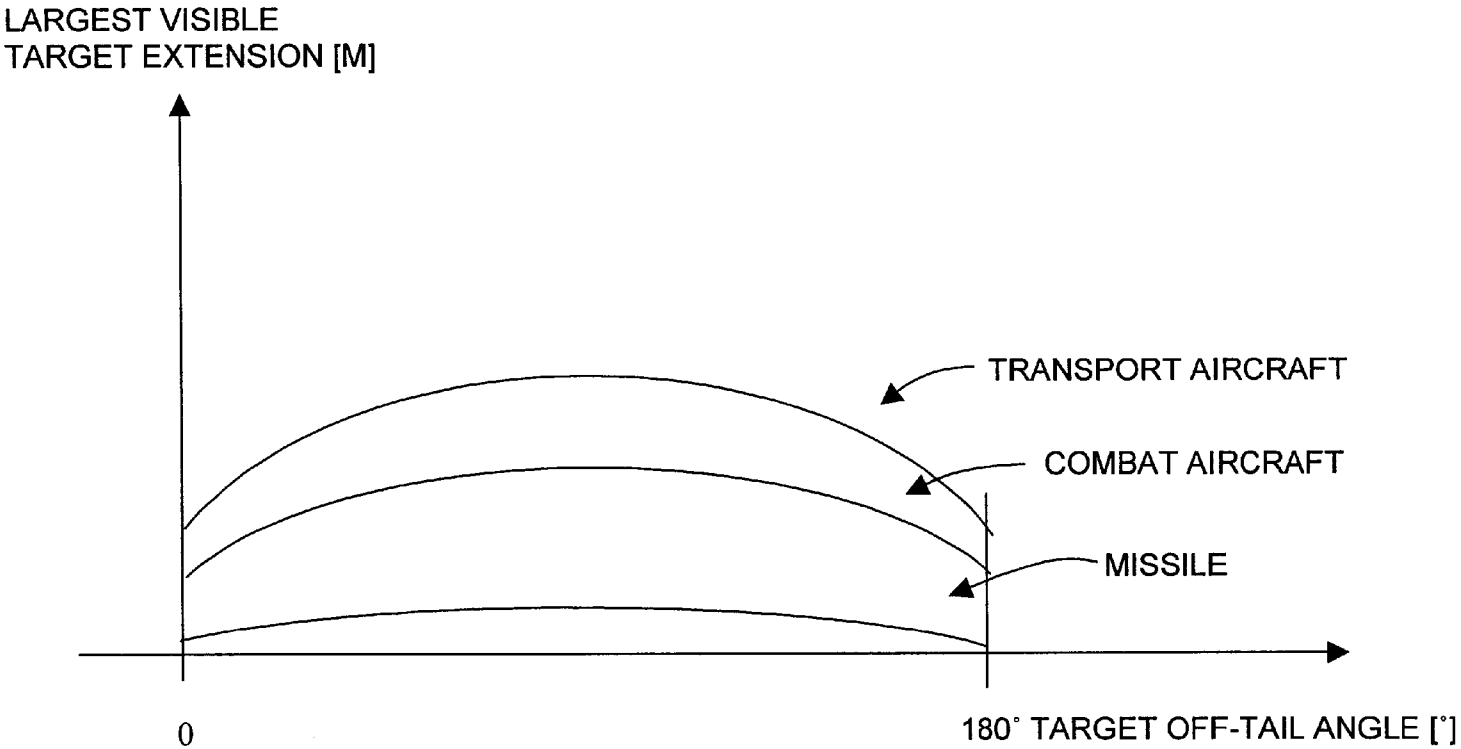
FIG. 3 is a diagram and shows, for different target types, the largest visible target dimensions in meters as a function of the off-tail angle.

The largest visible target dimension (in meters) corresponds to the distance between the maximally spaced target points and is a function of this off-tail angle, as illustrated in FIG. 3. If the target, an aircraft or a missile, is seen from the rear, that means that the off-tail angle is zero, then the largest visible target dimension is very small. The same is true for the observation of the target from the front, that means for an off-tail angle of 180°. Therebetween is a range, in which the target is seen from the side and the largest visible target extension is large. In FIG. 3 this largest visible target extension is illustrated as functions of the off-tail angle for some target types, namely for a large transport aircraft, for a small combat aircraft and for a missile. These are typical values. The real values can, of course, slightly deviate from these curves in a specific case.

Figure 4:
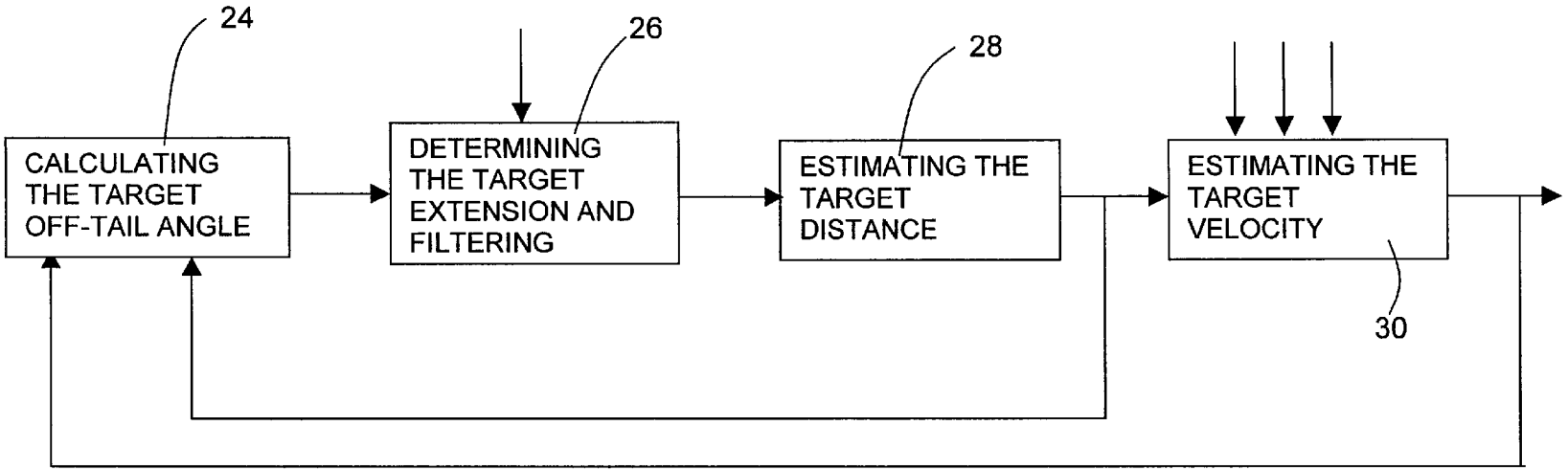
FIG. 4 is a block diagram and shows the recursive algorithm.

FIG. 4 shows as block diagram a recursive algorithm, by means of which estimated values for the three-dimensional vector of the target velocity is obtained in a seeker head-fixed coordinate system from the predetermined maximum absolute size of the target and the size of the target image observed by the seeker head and, in known manner, dependent on the direction of observation.

The algorithm supplies an estimated value for the vector of the velocity of the target 14 in the coordinate system of the seeker head of the missile 10. This vector is designated by $$\underline{v}_{Te}^{h}.$$

As illustrated by block 24, the off-tail angle OTA, under which the seeker head of the missile 10 observes the target 14, is calculated from this estimated value $$\underline{v}_{Te}^{h}.$$

This is effected according to the relation $$\cos(OTA) = \frac{\underline{v}_{Te,x}^{h}}{|\underline{v}_{Te}^{h}|}$$

$$\underline{v}_{Te,x}^{h}$$

being the first component of the vector $$\underline{v}_{Te}^{h}.$$

The off-tail angel OTA obtained therefrom is "applied" to block 26. Before firing the missile, the block 26 obtains, through the launcher, the target type and, thus, the memory-stored function of the largest visible target extension $I_{max}$ (in meters) as a function of the off-tail angle OTA, as illustrated in FIG. 3. The target extension $I_{Tmax}$ visible under the off-tail angle results from this function and the off-tail angle OTA.

Block 28 illustrates the estimation of the target distance re. For estimation of the target distance, the size of the target image at the seeker head is compared to the value $I_{Tmax}$ of block 26. The smaller the target image is on the image resolving detector of the seeker head, the larger is the target distance. This estimated target distance $r_e$ is "applied" to a block 30. The block 30 represents the formation of an estimated value for the velocity $$\underline{v}_{Te}^{h}$$

of the target in the seeker-head-fixed coordinate system "h". For this purpose the block 30 receives three directly measurable quantities. These quantities are an estimated value for the inertial line-of-sight angular rate $$\underline{\dot{\sigma}}^{h},$$

the remaining time of flight $t_{go}$ and the velocity $$\underline{v}_{M}^{h}$$

of the missile. The line-of-sight angular rate and the velocity of the missile are again referenced to the coordinate system "h" fixed to the seeker head.

The line-of-sight angular rate $$\underline{\dot{\sigma}}^{h}$$

is measured in that the coordinate system fixed to the seeker is inertially stabilized with respect to the angular movements of the missile and the target is tracked with this coordinate system as a function of target deviation angles, the line-of-sight angular rate being determined from this tracking. A measuring value for the remaining time of flight is determined from this tracking. A measuring value for the remaining time of flight is determined from the enlargement of the target image in the image processing seeker head during the approach to the target. The missile velocity is determined by means of an inertial navigation unit. An estimate value $$\underline{v}_{Te}^{h}$$

for the velocity of the target relative to the missile in a three-dimensional vector is calculated with reference to the coordinate system "h" fixed to the seeker from the estimated value $r_e$ of the target distance and the three mentioned directly measured quantities. This is effected according to the following relations:

$$\underline{v}_{Te,x}^{h} = \underline{v}_{Mx}^{h} - \frac{r_e}{t_{go}}$$

$$\underline{v}_{Te,y}^{h} = \underline{v}_{My}^{h} + r_e\dot{\sigma}_{Z}^{h}$$

$$\underline{v}_{Te,z}^{h} = \underline{v}_{Mz}^{h} - r_e\sigma_{y}^{h}.$$

Therein, the vector $$\underline{v}_{Te}^{h}$$

is the estimated vector of the target velocity in the coordinate system "h" of the of the seeker, the vector $$\underline{v}_{M}^{h}$$

is the vector of the missile velocity likewise in the coordinate system of the seeker, $r_e$ is the estimated distance between missile and target and $$\dot{\sigma}$$

is the inertial line-of-sight angular rate in the seeker system.

The thus obtained estimated values for the vector $$\underline{v}_{Te}^{h}$$

is "returned" to the block 24 as illustrated. The estimated value $r_e$ is likewise "returned". This "return" symbolized a recursion. This means that the described calculation steps are repeated recursively while using the last obtained estimated values and the eventually changed direct measured values. The estimated values are continually improved during the recursion.

The estimated value for the target distance r, can be used in order to trigger the war head. Separate distance measuring means as radar or laser approach sensors are not required.

The relative trajectory angle between missile and target can be determined from the estimated value for the velocity of the target in the coordinate system "h" fixed to the seeker from the relation $$\cos(P) = \frac{\underline{v}_M \underline{v}_{Te}}{|\underline{v}_M||\underline{v}_{Te}|}$$

The numerator is the scalar product of the two velocity vectors $$\underline{v}_{Te}^{h}$$

and $$\underline{v}_{M}^{h}.$$

The denominator is the product of the vector lengths.

Figure 5:
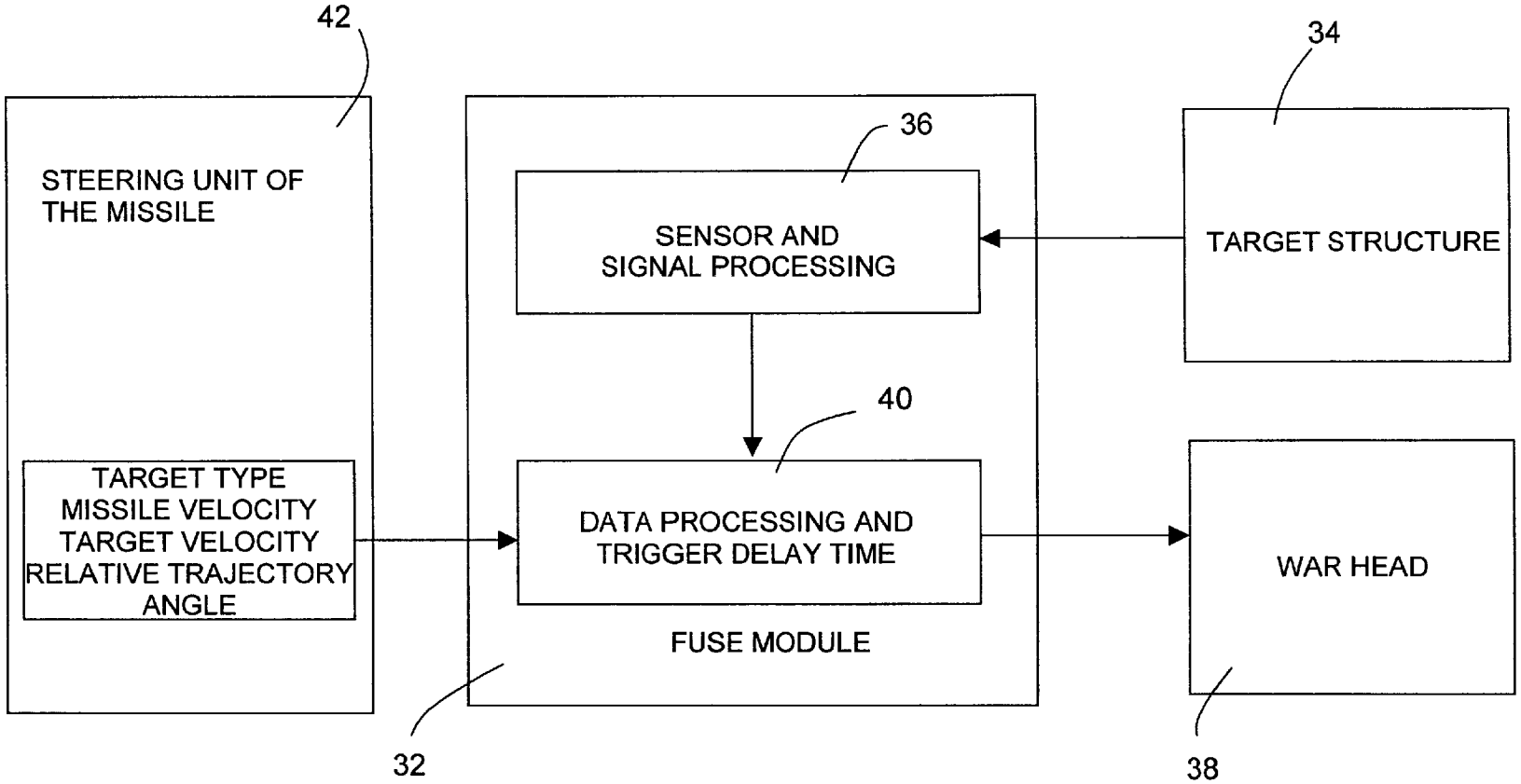
FIG. 5 is a block diagram of the fuse module of a missile and illustrates the influence of the different quantities obtained from the algorithm on the fuse delay law.

FIG. 5 shows a fuse module 32 of the missile. Numeral 34 designates the visible target structure. The image resolving sensor of the seeker head and the described signal processing illustrated by block 36 supplies a distance signal $r_e$, which initiates the triggering of the war head 38 when falling below a determined value. Instead thereof, also a separate distance sensor can be provided. A block 40 represents a data processing, through which a trigger delay time is calculated and a corresponding trigger delay is effected as a function of target type, velocity of the missile, velocity of the target and relative trajectory angle 18. The velocity of the target and the relative trajectory angle are obtained in the manner described above from the steering unit 42 of the missile.

In similar manner, the steering amplification in the guidance law can also be optimized in accordance with the off-tail angle and the target velocity.

We claim:

1. A method for determining the relative movement between a target tracking missile and a target being located at a target distance from said missile and moving with a target velocity relative to said missile, said missile being provided with an image processing seeker head provided with a seeker detecting said target, said seeker head observing the target in an observation direction, a target image having a target image dimension being generated on said seeker when said seeker detects said target and depending on said observation direction, said method comprising the steps of:

defining a seeker head fixed coordinate system;

defining a maximal absolute size of said target;

measuring further relevant quantities; and running a recursive algorithm in order to obtain estimated values for a three-dimensional vector of said target velocity in said seeker head-fixed coordinate system, using as inputs said defined maximal absolute size of said target and said image dimensions generated on said seeker as well as said further relevant quantities.

2. The method of claim 1, further comprising the method steps of:

(a) determining a target type and defining a maximal absolute target size thereof;

(b) storing a table of visible absolute target sizes as a function of off-tail angle for at least one target type;

(c) estimating said target distance by using said target image dimension appearing in said seeker and the visible real target size at an estimated off-tail angle;

(d) determining the missile velocity, the line-of-sight angular rate and the remaining time of flight;

(e) estimating said three-dimensional vector of said relative target velocity in said seeker head-fixed coordinate system;

(f) determining a target tail-off angle from the relative target velocity; and (g) repeating steps (c) to (f) while using the last calculated target tail-off angle.

3. The method of claim 2, wherein the method steps (c) to (g) are repeated recursively.

4. The method of claim 2, wherein the missile velocity is determined by means of an inertial navigation unit.

5. The method of claim 2, wherein said seeker-head-fixed coordinate system is inertially stabilized with respect to the angular movements of said missile and said target is tracked with said coordinate system as a function of target deviation angles, the line-of-sight angular rate being determined from this tracking.

6. The method of claim 2, wherein a measuring value for the remaining time of flight is determined by using the enlargement of said target image in said image processing seeker head during the approach to said target.

7. The method of claim 1, wherein an estimated value of said vector of said target velocity in said coordinate system fixed to said seeker head is determined according to the following relations:

$$\underline{v}_{Te,x}^{h} = \underline{v}_{Mx}^{h} - \frac{r_e}{t_{go}}$$

-continued $$\underline{v}_{Te,y}^{h} = \underline{v}_{My}^{h} + r_e \dot{\sigma}_z^h$$

$$\underline{v}_{Te,z}^{h} = \underline{v}_{Mz}^{h} - r_e \dot{\sigma}_y^h,$$

the vector $$\underline{v}_{Te}^{h}$$

being the estimated vector of the target velocity in the coordinate system (h) of the of the seeker, the vector $$\underline{v}_{M}^{h}$$

being the vector of the missile velocity likewise in the coordinate system of the seeker, $r_e$ being the estimated distance between missile and target and $$\dot{\sigma}$$

being the inertial line-of-sight angular rate in the seeker system.

8. The method of claim 7, wherein said target off-tail angle OTA is determined from the $$\cos(OTA) = \frac{\underline{v}_{Te,x}^{h}}{|\underline{v}_{Te}^{h}|}.$$

9. The method of claim 7, wherein the relative trajectory angle between missile and target is determined from the relation:

$$\cos(P) = \frac{\underline{v}_M \underline{v}_{Te}}{|\underline{v}_M||\underline{v}_{Te}|}.$$

10. The method of claim 1, wherein a trigger delay time of a war head of said missile is optimized in accordance with the observed target structure, the relative target velocity and the relative trajectory angle.

11. The method of claim 1, wherein the steering amplification in the steering law is optimized depending on the off-tail angle and the target velocity.

* * * * *